US008875479B2

(12) United States Patent
Johnston

(10) Patent No.: US 8,875,479 B2
(45) Date of Patent: Nov. 4, 2014

(54) POLYMERIC COATING APPLICATORS AND METHODS OF FILLING SAME

(75) Inventor: Matthew L. Johnston, Toms River, NJ (US)

(73) Assignee: Milspray LLC, Lakewood, NJ (US)

( * ) Notice: Subject to any disclaimer, the term of this patent is extended or adjusted under 35 U.S.C. 154(b) by 754 days.

(21) Appl. No.: 13/065,178

(22) Filed: Mar. 16, 2011

(65) Prior Publication Data

US 2012/0103463 A1 May 3, 2012

Related U.S. Application Data

(60) Provisional application No. 61/456,100, filed on Nov. 1, 2010.

(51) Int. Cl.
*B65B 55/18* (2006.01)
*B65B 31/02* (2006.01)

(52) U.S. Cl.
CPC ..... *B65B 31/025* (2013.01)
USPC ..... 53/470; 53/432; 53/111 RC; 53/431

(58) Field of Classification Search
USPC ..... 53/432, 510, 426, 431, 127, 111 RC, 53/470
See application file for complete search history.

(56) References Cited

U.S. PATENT DOCUMENTS

| | | | | | |
|---|---|---|---|---|---|
| 1,096,797 | A * | 5/1914 | Snelling | 206/0.7 |
| 3,087,707 | A * | 4/1963 | Moonan | 366/130 |
| 3,247,640 | A * | 4/1966 | De Wayne Miles et al. | 53/470 |
| 3,710,538 | A * | 1/1973 | Lowy et al. | 53/428 |
| 4,382,685 | A * | 5/1983 | Pearson | 366/241 |
| 4,533,515 | A * | 8/1985 | Witter et al. | 422/26 |
| 4,641,974 | A * | 2/1987 | Church | 366/342 |
| 5,178,841 | A * | 1/1993 | Vokins et al. | 422/298 |
| 5,236,262 | A * | 8/1993 | Espey | 366/130 |
| 5,829,648 | A * | 11/1998 | Goeren et al. | 222/321.7 |
| 6,629,402 | B1 * | 10/2003 | Zawalick | 53/432 |
| 6,769,572 | B1 * | 8/2004 | Cullotta | 222/5 |
| 7,581,654 | B2 * | 9/2009 | Stowitts | 215/383 |
| 7,685,796 | B2 * | 3/2010 | Capelli et al. | 53/510 |
| 8,182,762 | B2 * | 5/2012 | Guasch | 422/402 |
| 8,235,712 | B1 * | 8/2012 | Lewis | 432/121 |
| 2010/0233146 | A1 * | 9/2010 | McDaniel | 424/94.2 |
| 2010/0252580 | A1 * | 10/2010 | Bredbenner | 222/318 |
| 2011/0240064 | A1 * | 10/2011 | Wales et al. | 134/26 |
| 2011/0258825 | A1 * | 10/2011 | Johnston | 29/401.1 |

* cited by examiner

*Primary Examiner* — Stephen F Gerrity
*Assistant Examiner* — Eyamindae Jallow
(74) *Attorney, Agent, or Firm* — Robert M. Skolnik

(57) ABSTRACT

A method of filling CARC (chemical agent resistant coating) applicators ensures integrity of the CARC paint. The method incorporates the steps of the steps of pre-priming a container and applicator with a solvent to ensure evacuation of air; pre-reducing the chemical agent resistant coating with a reduction thinning agent to a final viscosity such that the final assembled applicator produces an atomization mist suitable to apply said coating; agitating the pre-reduced coating on a paint shaker; continuously purging a hermetically sealed chamber with nitrogen or another dry inert gas; preheating all items that will come in direct contact with said coating to eliminate any residual moisture within each item; assembling said dry preheated items and immediately transferring them into said chamber inserting steel sphere agitation units into a dried container, such that each container contains three small spheres and one large sphere; transferring the coating into said chamber prior to opening said container; filling said container; and purging the filled container with nitrogen or other inert gas then immediately sealing said container and removing it from said chamber.

9 Claims, No Drawings

POLYMERIC COATING APPLICATORS AND METHODS OF FILLING SAME

CROSS-REFERENCE TO RELATED APPLICATIONS

Applicant claims priority of U.S. Provisional Patent Application 61/456/100, filed Nov. 1, 2010.

The present invention related to apparatus for applying polymeric coatings in military, commercial, or industrial applications, power spray and trigger/pump spray applicators for these coatings and methods of filling the applicators.

SUMMARY OF THE INVENTION AND DESCRIPTION OF RELATED ART

The invention has specific utility in the military application of CARC, (chemical agent resistant coating). It is applied to military vehicles to provide resistance to chemical and biologic agents. The CARC coating permits vehicles and equipment to be more easily decontaminated in the event of exposure to chemical and biological agents.

In addition, CARC provides both visual camouflage and IR signature management. It is the IR signature management that is critical to maintain true camouflage. For example, by mimicking the IR signature of a heavily wooded environment, a vehicle having a woodland camo CARC finish is more difficult to identify because its IR signature appears to be the same as its surrounding environment.

As many passive missile guidance systems use IR signatures as a primary means of tracking targets, effective application of CARC coating enhances survivability. As will now be apparent, it is important to be able to "touch up" the CARC coating with touch up paint that possesses these same qualities.

As will now be understood, it is essential that the CARC coating maintain its integrity so that when it is applied as a touch up, degradation of survivability will be minimized.

The present invention provides a trigger or a vertical pump type sprayer and a powered spray gun applicator to allow the CARC material to be applied in a convenient manor and methods of filling the sprayers which inhibits CARC exposure to any element which will cause it to degrade in its container. The invention also includes a multi-stage agitation system for minimizing sediment formation at the bottom of the containers during storage. This agitation system includes a plurality of steel spheres, one of which has a larger mass than the others.

One prior art device for applying a touch up CARC coating is shown and described in U.S. Pat. No. 7,338,27, issued Mar. 4, 2008, commonly assigned. That applicator uses a two component CARC coating requiring mixing before application. The prior use of two component CARC has thus limited the effectiveness and ease of use of aerosol spray applicators for CARC.

Another device is sold under the trademark PREVAL. While aerosol cans of coatings are commonplace, it has been difficult to put single component moisture cure CARC coating into a traditional aerosol container. The coating cures by reaction with moisture and it has proven difficult to exclude moisture during the filling of aerosol cans. It is however possible to use a can of aerosol propellant of the type sold under the trademark PREVAL to make a type of aerosol paint. The PREVAL sprayer unit includes a pressurized container with a plastic tube to take up the paint. The unit also has threads so that a plastic bottle containing a small quantity of paint may be attached to the PREVAL unit and sprayed by aerosol. The unit will not operate when held at an angle greater than 45° and clogs easily.

The applicators of the present invention may also be used to apply all types of polymeric coatings in other military applications as well as for commercial and industrial uses. These applicators work well with polymeric coatings such as urethane, epoxy, latex, acrylic, etc., regardless of water or solvent dispersions and regardless of single or dual component formats. The applicators are characterized by its atomization of polymeric coatings by means of an airless/non-propellant transference of the liquid coating from a reservoir, thus channeled through a restricted orifice nozzle by manual contraction/squeezing of a lever or pump actuated pumping assembly.

DETAILED DESCRIPTION OF THE INVENTION

I have found that certain trigger and pump sprayers can be used to apply the polymeric coatings described above. The products described below have been tested with: CARC Single-Component polyurethane; CARC Two-Component polyurethane; waterborne epoxy primer; and solvent borne epoxy primer.

These sprayers are:

1. Trigger action with pump offset at 45-degrees, Item HT-22210, available from McKernan Packaging Clearinghouse, PO Box 7281, Reno, Nev. 89510;
2. Trigger action with pump offset at 90-degrees; Item 0240004, available from Parish Maintenance Supply Corp., PO Box 185, 114 Palmeter St., Syracuse, N.Y. 13206;
3. Trigger action with inline pump at 180-degrees, Item HT-18610, available from McKernan Packaging Clearinghouse.
4. Push button action with inline pump at 180-degrees, Item HF-22771, available from McKernan Packaging Clearinghouse.
5. Paint gun (air assist paint sprayer) models 62 and 63 available from Paasche Airbrush Co., Chicago, Ill.

Heat-Shrink Sleeve and Heat-Shrink Dome Bags:

Distributed by Ameri-Seal, Inc., 21330 Superior Street, Chatsworth, Calif. 91311

Container:

Distributed by CCL Container; 1 Llodio Drive; Hermitage, Pa. 16148.

Seamless, drawn aluminum container.

Epoxy-phenolic lined.

Thread impressed/stamped within the aluminum neck.

Two-Stage Spherical Agitation Units:

Distributed by Frantz Manufacturing Company; PO Box 497; Sterling, Ill. 61081-0497.

The smaller agitator size is relative to the radius of the bottom shoulder of the container.

Multiple (three) 4.7625 mm high density carbon steel bearings designed to sweep the lower circumference of the container to reincorporate sediment that accumulates along the bottom radius.

The larger agitator size is relative to diameter of the smaller agitators such that there remains interaction between the agitation units.

Single 14.2875 mm high density carbon steel bearing for impact and bulk reincorporation of larger masses of sediment; also serves to dislodge the smaller agitators should they become impacted.

Packaging Method:

The trigger spray pumping assembly and dip-tube is pre-primed and filled with solvent prior to final assembly, thus ensuring evacuation of all air within the trigger spray unit.

The coatings are pre-reduced with an appropriate reduction thinning agent to a final viscosity such that the final assembled trigger-spray unit produces an atomization mist suitable to apply a coating.

Preparation Procedure:

a. Prior to distribution of liquid coatings, the bulk liquid material is agitated on a Red Devil® style paint shaker for 10 minutes, b. All distribution of liquid coatings are performed within a hermetically sealed chamber continually purged with nitrogen or other dry inert gas, c. All necessary equipment and supplies, i.e. viscometer, balances, and solvents, are within the chamber (b.), d All aluminum containers, caps, seals, trigger spray-head units, dual sized agitators, all transfer vessels, and all items that will come in direct contact with the liquid coating are preheated in an oven to a temperature not less than 120 F for a minimum of 20 minutes to eliminate any residual moisture within each component, e. The dry, preheated containers, caps, seals, trigger spray-head units, dual sized agitators are lightly assembled and transferred immediately into the chamber (b.), f. All transfer vessels and items that will come in contact with the liquid coating are immediately transferred from the oven into the chamber (b.), g. The steel sphere agitation units are inserted into the aluminum containers such that each container contains three small spheres and one large respectively, h. The bulk liquid material is transferred into the chamber (b.) prior to opening its container.

Filling Procedure:

i. The bulk liquid material is opened and portioned into each aluminum container until filled to specified volume or mass respectively, j. Upon completion of each filled container, the filled container itself is purged with nitrogen or other inert gas then immediately sealed using one trigger spray-head unit, k. Each filled and assembled container is then removed from the chamber (b.).

Outer Packaging Procedure:

l. Each completed unit as described upon completion of steps (a.) through (k.) is then encased by a non-permeable heat-shrink sleeve encompassing the neck portion of the bottle and base of the trigger-spray unit, extending from the upper shoulder region of the aluminum bottle, over the threaded base of the spray-head assembly, and overlapping the bottom portion of the trigger spray-head throat portion.

m. The heat-shrink sleeve is then thermally secured into position in accordance to its manufacturer's recommendations.

n. The complete assembly is then encapsulated by a heat-shrink dome bag, thus creating a complete outer protective vapor barrier enveloping the top of the assembly, extending under the lower ridge of the aluminum bottle, and thermally secured in accordance with its manufacture's recommendations.

Another embodiment of the invention utilizes the Paint gun (air assist paint sprayer) attached to the CARC container and further attached to an external propellant source. In this embodiment the container is:

Aluminum bottle #AG12040

Distributed by:

Elemental Container
860 Springfield Road South
Union, N.J. 07083
908-687-7720

It is:

100% recyclable.
Seamless drawn 1050A grade aluminum,
Unlined interior,
Polished rolled 28 mm opening,
Smooth, unthreaded cylindrical neck,
Container neck overlayment is a single molded polypropylene continuous thread DIN-42 and clasping system,
Bottle opening is rolled over the polypropylene threads for added seal features and thread securing, Two-Stage Spherical Agitation Units:

Distributed by:

Frantz Manufacturing Company
PO Box 497
Sterling, Ill. 61081-0497
815-625-7063.

The smaller agitator size is relative to the radius of the bottom shoulder of the container.

Multiple (three) 7.9375 mm high density carbon steel bearings designed to sweep the lower circumference of the container to reincorporate sediment that accumulates along the bottom radius, The larger agitator size is relative to diameter of the smaller agitators such that there remains interaction between the agitation units.

Single 14.2875 mm high density carbon steel bearing for impact and bulk reincorporation of larger masses of sediment; also serves to dislodge the smaller agitators should they become impacted.

Closure System:

Plug Seal: #028PLUG

Distributed by:

Elemental Container
860 Springfield Road South
Union, N.J. 07083
908-687-7720

LDPE construction,
28 mm×13.5 mm insertable depth with a 5.5 mm seal brim,
Cylindrical design,
In-mold pull-ring removal
Screw Cap Seal: #40CAP00.

Distributed by:

Elemental Container
860 Springfield Road South
Union, N.J. 07083
908-687-7720

Single piece polypropylene construction,
DIN42 continuous thread,
Tamper evident clasping system,
Aluminized Mylar laminated solvent resistant high density foam compression lining.

Packaging Method:

A non-clasping cap refers to a properly fitted cap without a clasping tamper evident feature.

The coatings are pre-reduced with an appropriate reduction thinning agent to a final viscosity such that the final assembled spray unit produces an atomization mist suitable to apply a coating.

Preparation Procedure:

a. Prior to distribution of liquid coatings, the bulk liquid material is agitated on a Red Devil® style paint shaker for 10 minutes, b. All distribution of liquid coatings are performed within a hermetically sealed chamber continually purged with nitrogen or other dry inert gas, c. All necessary equipment and supplies, i.e. viscometer, balances, and solvents, are within the chamber (b.), d. All aluminum containers, caps, seals, plugs, steel spheres, all transfer vessels, and all items that will come in direct contact with the liquid coating are preheated in an oven to a temperature not less than 120 F for a minimum of 20 minutes to eliminate any residual moisture within each component, e. The dry, preheated containers, caps, seals, plugs, and steel spheres are lightly assembled and transferred immediately into the chamber (b.), f. All transfer vessels and items that will come in contact with the liquid coating are immediately transferred from the oven into the chamber (b.), g. The steel sphere agitation units are inserted into the aluminum containers such that each container contains three small spheres and one large respectively, h. The bulk liquid material is transferred into the chamber (b.) prior to opening its container, Filling Procedure:

i. The bulk liquid material is opened and portioned into each aluminum container until filled to specified volume or mass respectively, j. Upon completion of each filled container, the filled container itself is purged with nitrogen or other inert gas then immediately sealed using one plug insert and one nonclasping cap, k. The container (j.) is then set aside within the chamber (b.) until transferred into an explosion resistant oven, l. The containers, upon completion of item 3.k. are transferred into a preheated 140 F explosion resistant oven for a given time at which the coatings within the container reach an internal temperature of 130 F, m. Upon reaching the targeted temperature, the containers are removed from the oven and immediately placed within a chamber (b.), n. Without allowing the container to cool, the nonclasping cap is removed (j.), o. Immediately, the plug insert is slightly loosened to relieve gaseous pressure built within the container, then immediately seated back into its inserted position, p. A clasping tamper evident cap is immediately affixed to the hot container and torqued to the manufacturer's recommendation, q. After completion in sequence of all previous steps, the containers, upon cooling, develop a thermally induced vacuum environment internally which allows all components to establish their full seal potential.

Further modifications to the methods and apparatus of the invention may be made without departing from the spirit and scope of the invention.

I claim:

1. A method of filling a chemical agent resistant coating container and applicator comprising the steps of:

pre-heating the chemical agent resistant coating container, as well as, steel sphere agitation units that will come in direct contact with a chemical agent resistant coating, to eliminate any residual moisture within the chemical agent resistant coating container and on the steel sphere agitation units;

wherein the steel sphere agitation units include both large and small spheres;

pre-reducing said chemical agent resistant coating with a reduction thinning agent to a final viscosity;

wherein the final viscosity produces a consistency suitable for atomization mist by the applicator;

agitating the pre-reduced chemical agent resistant coating on a paint shaker;

transferring the pre-heated chemical agent resistant coating container, the pre-heated steel sphere agitation units, and the pre-reduced, agitated chemical agent resistant coating into a chamber;

wherein the chamber is continuously purged and hermetically sealed with either nitrogen or a dry inert gas;

inserting said pre-heated steel sphere agitation units into said pre-heated chemical agent resistant coating container within said chamber, such that each chemical agent resistance coating container contains three small spheres and one large sphere;

filling said chemical agent resistant coating container with the pre-reduced chemical agent resistant coating; and purging the filled chemical agent resistant container with nitrogen or other inert gas, then immediately sealing said chemical agent resistant coating container and removing it from said chamber.

2. The method of claim 1 further including the step of: pre-priming the container and applicator with a solvent to ensure evacuation of air therefrom.

3. The method of claim 2 further including the steps of: encasing each of said filled containers with a non-permeable heat-shrink sleeve; thermally securing said heat-shrink sleeve into position; and encapsulating said container in an outer protective vapor barrier.

4. The method of claim 1 further including the steps of: transferring said purged filled container into a preheated explosion resistant oven to heat the coating to a predetermined temperature; upon reaching said predetermined temperature removing said container from said oven and immediately placing it in said chamber; and without permitting said container to cool, applying a tamper evident cap onto said container whereby said container, when cooled develops a thermally induced vacuum environment internally.

5. A method of filling a chemical agent resistant coating container and applicator comprising the steps of:

pre-reducing a chemical agent resistant coating to a viscosity such that the applicator may produce an atomization mist;

agitating the pre-reduced chemical agent resistant coating;

pre-heating the chemical agent resistant coating container, as well as, steel sphere agitation units that will come in direct contact with a chemical agent resistant coating, to dry the chemical agent resistant coating container and the steel sphere agitation units;

transferring the dried chemical agent resistant coating container, the dried steel sphere agitation units, and the pre-reduced, agitated chemical agent resistant coating into a chamber;

wherein the chamber is continuously purged and hermetically sealed with dry inert gas;

inserting the dried steel sphere agitation units into the dried chemical agent resistant coating chamber container;

filling said chemical agent resistant coating container with the pre-reduced chemical agent resistant coating; and purging the filled chemical agent resistant container with inert gas, then immediately sealing said chemical agent resistant coating container and removing it from said chamber.

6. The method of claim 5 further including the step of pre-priming the container and applicator to ensure evacuation of air therefrom.

7. The method of claim 6 further including the steps of: encasing each of said filled containers with a non-permeable heat-shrink sleeve; thermally securing said heat-shrink sleeve into position; and encapsulating said container in an outer protective vapor barrier.

8. The method of claim 5 further including the steps of: producing a thermally induced vacuum environment to further seal said container.

9. The method of claim 8 wherein said thermally induced vacuum environment is produced by heating said container to a predetermined temperature, and immediately sealing said container in said chamber.

* * * * *